United States Patent [19]

Lew et al.

[11] Patent Number: 4,807,408

[45] **Date of Patent: * Feb. 28, 1989**

[54] GEODESICALLY REINFORCED HONEYCOMB STRUCTURES

[75] Inventors: Hyok S. Lew, 7890 Oak St., Arvada, Colo. 80005; Michael Stranahan, Woody Creek, Colo.

[73] Assignees: Jung G. Lew; Hyok S. Lew, Arvada, Colo.

[ * ] Notice: The portion of the term of this patent subsequent to Aug. 5, 2003 has been disclaimed.

[21] Appl. No.: 129,782

[22] Filed: Dec. 7, 1987

Related U.S. Application Data

[63] Continuation-in-part of Ser. No. 892,592, Aug. 4, 1986, Pat. No. 4,711,057, which is a continuation-in-part of Ser. No. 682,675, Dec. 17, 1984, Pat. No. 4,603,519.

[51] Int. Cl.[4] ..... E04B 1/32

[52] U.S. Cl. ..... 52/81; 52/646; 52/664; 52/808

[58] Field of Search ..... 52/81, 609, 648, 86, 52/80, 608, 808, 669, 664, DIG. 10

[56] References Cited

U.S. PATENT DOCUMENTS

| | | | |
|---|---|---|---|
| 536,435 | 3/1895 | MacDonald | 52/664 |
| 2,918,992 | 12/1959 | Gelsavage | 52/81 |
| 3,139,957 | 7/1964 | Fuller | 52/648 |
| 3,186,522 | 6/1965 | McCanley | 52/81 |
| 3,533,849 | 10/1970 | Engelbrecht | 52/806 |
| 3,881,284 | 5/1975 | Martin | 52/81 |
| 3,959,937 | 6/1976 | Spunt | 52/81 |
| 4,122,646 | 10/1978 | Sapp | 52/648 |
| 4,156,997 | 6/1979 | Decker | 52/648 |
| 4,439,958 | 4/1984 | Lew | 52/86 |
| 4,603,519 | 8/1986 | Lew | 52/648 |
| 4,711,057 | 12/1987 | Lew | 52/648 |

FOREIGN PATENT DOCUMENTS

| | | | |
|---|---|---|---|
| 127104 | 6/1902 | Fed. Rep. of Germany | 52/666 |
| 2112926 | 3/1971 | Fed. Rep. of Germany | 52/86 |
| 424954 | 4/1974 | U.S.S.R. | 52/648 |
| 554358 | 5/1977 | U.S.S.R. | 52/81 |

*Primary Examiner*—Henry E. Raduazo

[57] ABSTRACT

This invention discloses a honeycomb structure comprising a network of hexagonal substructures sandwiched between two geodesic structures including network of triangular substructures wherein the corners of the triangular substructures are fastened to the alternating corners of the hexagonal substructures.

8 Claims, 1 Drawing Sheet

GEODESICALLY REINFORCED HONEYCOMB STRUCTURES

This application is a continuation-in-part of patent application 892,592 filed Aug. 4, 1986 and now U.S. Pat. No. 4,711,057 which is in turn a continuation in part from Ser. No. 682,675 filed Dec. 17, 1986 now U.S. Pat. No. 4,603,519.

BACKGROUND OF THE INVENTION

The well known geodesic structures pioneered by Buckminister Fuller, which comprises a single or double layers of geodesic structures including triangular substructures, provides two unique advantages which are, firstly, it enables one to construct a large scale unsupported dome without employing a long span beams or girders and, secondly, it provides a structure of highly futuristic appearance. While the conventional geodesic structure provides a unique way to built a large scale unsupported dome structure by using structural members of relatively small dimensions, it is less than an optimum structure in terms of the structural mechanics and less than ideal in terms of building economics. The geodesically reinforced honeycomb structure of the present invention has the same futuristic appearance as the conventional geodesic dome, while it provides a much improved strength to weight ratio and much better economics compared with the conventional geodesic structure.

SUMMARY OF THE INVENTION

The primary object of the present invention is to provide the geodesically reinforced honeycomb structures comprising a network of hexagonal substructures sandwiched between two networks of triangular substructures, wherein the corners of the triangular substructures are fastened to the alternate corners of the hexagonal substructures.

Another object is to provide the geodesically reinforced honeycomb structure erected efficiently and economically by assembling the preassembled subassemblies.

A further object is to provide the preassembled subassembly comprising shear force and bending moment bearing structural members arranged into a hexagonal assembly that is reinforced by two sets of axial load bearing structural members arranged into a triangular assembly, wherein each corner of the triangular assembly is fastened to each alternate corner of the hexagonal assembly.

Yet another object is to provide the preassembled subassembly covered with a planar member on at least one side.

Yet a further object is to provide the preassembled subassembly including means for joining a plurality thereof into a geodesically reinforced honeycomb structure.

These and other objects of the present invention will become clear as the description thereof progresses.

BRIEF DESCRIPTION OF THE FIGURES

The present invention may be described with a great clarity and specificity by referring to the following figures.

DESCRIPTION OF THE ILLUSTRATED EMBODIMENTS

Figure 1:
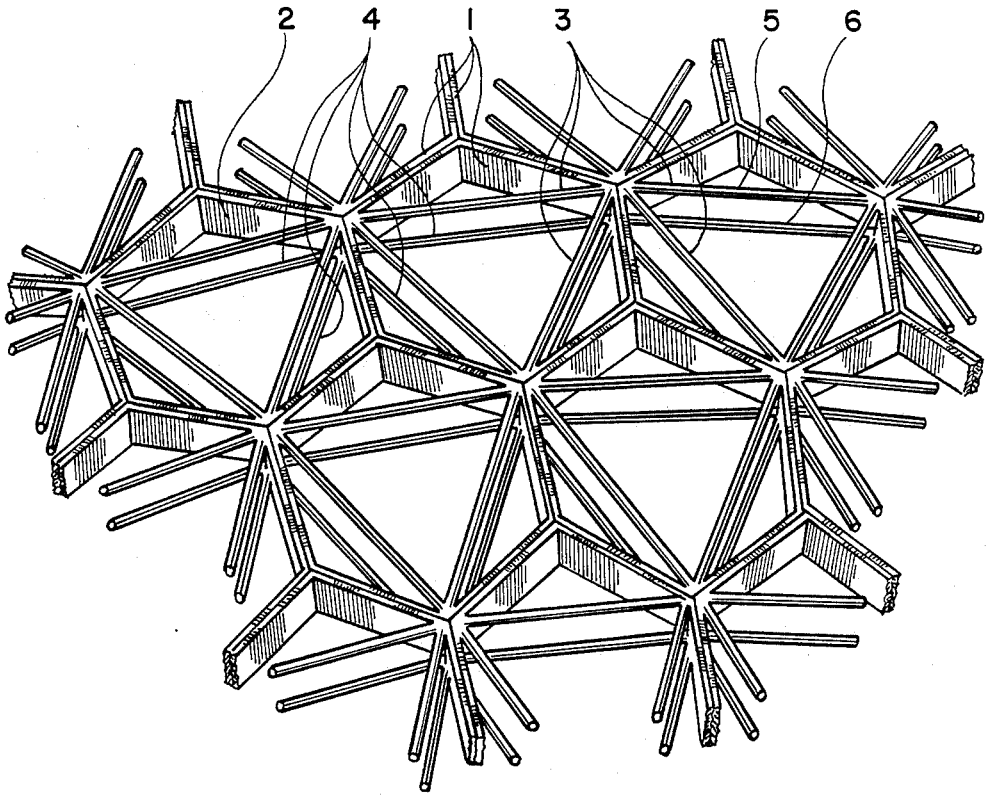
FIG. 1 illustrates a perspective view of a geodesically reinforced honeycomb structure constructed in accordance with the principles of the present invention.

In FIG. 1 there is illustrated a perspective view of a geodesically reinforced honeycomb structure constructed in accordance with the principles of the present invention, which comprises a honeycomb structure 1 including a network of hexagonal substructures 2 sandwiched between two geodesic structures 3 and 4 respectively including network of triangular substructures 5 and 6. The corners of the triangular substructure are fastened to the alternate corners of the hexagonal substructure. The hexagonal substructures are made of structural members having a cross section of sizable depth for bearing a shear force and bending moment, while the triangular substructures are made of structural members having a cross section of a balanced dimensions such as a solid or hollow circle for bearing axial loading. The geodesically reinforced honeycomb structures can be a flat or curved shell structures such as a spherical or cylindrical dome depending on the tapers included in the individual hexagonal substructures, which may be covered with planar plates or sheets on the top and/or bottom. The geodesically reinforced honeycomb structures can be erected by assembling individual structural members or by assembling preassembled subassemblies. The fastening means for assembling the structural members or the preassembled subassemblies may include welding, threaded fastening, rivetting, nailing, bonding, etc. depending on the structural and material requirements.

Figure 2:
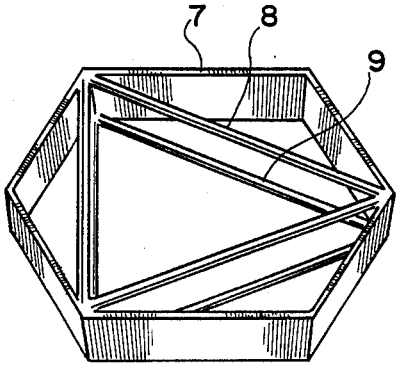
FIG. 2 illustrates an embodiment of the subassembly.

In FIG. 2 there is illustrated an embodiment of the preassembled subassembly employed in the construction of the geodesically reinforced honeycomb structures of the present invention, which comprises a hexagonal assembly 7 and two triangular assemblies 8 and 9. The hexagonal assembly 7 is a short section of a hexagonal shell or hexagonal shell frustum including six structural elements having a sizable cross sectional dimension in the axial direction of the hexagonal assembly for bearing a shear force and bending moment. The hexagonal assembly 7 is reinforced at one planar extremity thereof by the first triangular assembly 8 including three elongated structural members, which bear the axial loading and at the other planar extremity by the second triangular assembly 9. The corners of the two triangular assemblies 8 and 9 are fastened to the same alternate corners of the hexagonal assembly 7. The two triangular assemblies 8 and 9 must have slightly different dimensions in order to fit into the two planar extremities of the hexagonal assembly 7, when the hexagonal assembly 7 is tapered. The two triangular assemblies 8 and 9 may be disposed flush to the two planar extremities of the hexagonal assembly 7 or slightly recessed therefrom, respectively.

Figure 3:
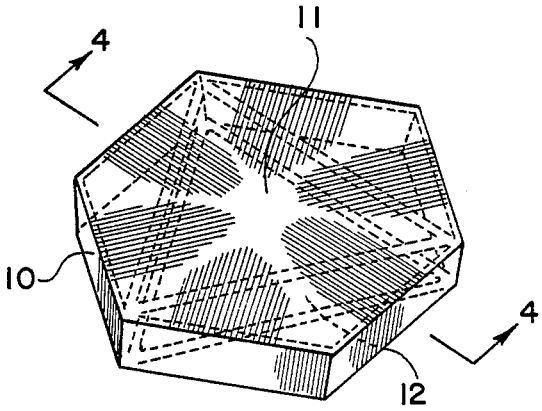
FIG. 3 illustrates an embodiment of the subassembly with covered top and/or bottom.

In FIG. 3 there is illustrated an embodiment of the preassembled subassembly with a covered top and/or bottom. One or both planar extremities of the subassembly 10 having the same construction as the embodiment shown in FIG. 2 is covered with planar members 11 and/or 12 of hexagonal configuration, which may be opaque or transparent sheets or plates secured to the hexagonal assembly 10 following the edge thereof. In the illustrated embodiment, the two triangular assemblies are enclosed between the two cover sheets or plates 11 and 12. The two cover sheets 11 and 12 may be disposed intermediate the two triangular assemblies and adjacent to the two planar extremities of the hexagonal assembly in different embodiment.

Figure 4:
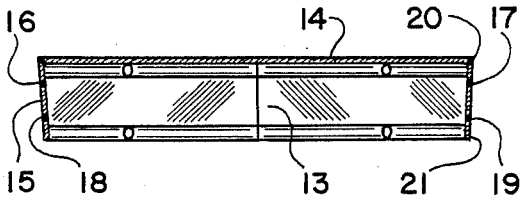
FIG. 4 illustrates a cross section of an embodiment of the subassembly with covered top or bottom.

In FIG. 4 there is illustrated a cross section of a subassembly such as the embodiment shown in FIG. 3, which cross section is taken along plane 4—4 as shown in FIG. 3. In this particular embodiment, only one planar extremity of the subassembly 13 is covered with a planar member 14. The structural members of the hexagonal assembly 15 includes a plurality of holes 16, 17, 18, 19, etc., which is for bolt connection or rivetting employed in locating, pulling and fastening adjacent subassemblies together or for venting the sealed interior of the subassembly. Of course, the subassemblies can be assembled by welding following the edges 20 and 21 of the subassembly.

Figure 5:
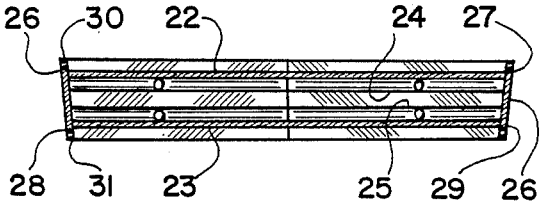
FIG. 5 illustrates a cross section of an embodiment of the subassembly with covered top and bottom.

In FIG. 5 there is illustrated another embodiment of the subassembly, which has both planar extremities covered with planar members 22 and 23. It should be noticed that the two triangular assemblies 24 and 25, and the two cover members 22 and 23 are slightly recessed from the two planar extremities of the hexagonal assembly 26, respectively. Such an arrangement provides access to the fastener holes 26, 27, 28, 29, etc. disposed following the two edges of the hexagonal member 26 in joining the subassemblies to each other. The two triangular assemblies 24 and 25 may be disposed flush to the two planar extremities of the hexagonal assembly, respectively, while the two cover members 22 and 23 are disposed adjacent to and intermediate the two triangular assemblies, which arrangement also provides access to the fastener holes disposed along the two edges of the hexagonal assembly. Of course, the two triangular assemblies and the two cover members can be disposed flush to the two planar extremities of the hexagonal assembly, when the welding along the two edges 30 and 31 of the subassembly is employed in joining the subassemblies together.

While the principles of the invention have now been made clear by the illustrative embodiments, there will be immediately obvious to those skilled in the art many modifications of the structures, arrangements, proportions, elements and materials which are particularly adapted to the specific working environments and operating conditions in the practice of the invention without departing from those principles. It is not desired to limit the invention to the particular illustrated embodiments shown and described and, accordingly, all suitable modifications and equivalents may be resorted to falling within the scope of the invention as defined by the claims which follow.

The embodiments of the invention in which an exclusive property or privilege is claimed are defined as follows:

1. A geodesically reinforced honeycomb structure comprising in combination:

(a) a plurality of elongated structural members having a generally slender cross section connected together to form a hexagonal network having a first and second surface;

(b) a first set of reinforcing elongated structural members arranged into a first triangular network superimposed to said hexagonal network at said first surface of said hexagonal network wherein each triangle of said triangular network includes three reinforcing elongated structural members with each corner connected to alternate corners of each hexagon of said hexagonal network; and (c) a second set of reinforcing elongated structural members arranged into a second triangular network superimposed to said hexagonal network at said second surface of said hexagonal network opposite to said first surface wherein each triangle of said triangular network includes three reinforcing elongated structural members with each corner connected to the same alternate corners of each hexagon as said first set of reinforcing elongated structural members in said hexagonal network;

wherein adjacent triangular cells included in said triangular networks are connected to each other in a corner-to-corner pattern.

2. The combination as set forth in claim 1 wherein said geodesically reinforced honeycomb structure is covered with planar members at at least one of said first and second surface.

3. The combination as set forth in claim 1 wherein said geodesically reinforced honeycomb structure is a curved shell.

4. The combination as set forth in claim 3 wherein said geodesically reinforced honeycomb structure is covered with planar members at at least one of said first and second surface.

5. A component assembly for geodesically reinforced honeycomb structure comprising in combination:

(a) a plurality of elongated structural members capable of bearing shear force and bending moment connected together to form a hexagonal assembly of a substantial thickness defining two planar extremities on opposite sides of said substantial thickness;

(b) a first set of elongated structural members capable of bearing an axial loading arranged into a first triangular assembly disposed within said hexagonal assembly adjacent to one of said planar extremities wherein each corner of said first triangular assembly is connected to alternate corners of said hexagonal assembly;

(c) a second set of elongated structural members capable of bearing an axial loading arranged into a second triangular assembly disposed within said hexagonal assembly adjacent to the other of said two planar extremities wherein each corner of said second triangular assembly is connected to the same alternate corners of said hexagonal assembly as said first triangular assembly; and (d) means included in said component assembly for accommodating connection means for connecting said component assembly to other component assembly adjacent thereto.

6. The combination as set forth in claim 5 wherein at least one of said two extremities of said component assembly is covered with a planar member.

7. The combination as set forth in claim 5 wherein said hexagonal assembly is tapered.

8. The combination as set forth in claim 7 wherein at least one of said two extremities of said component assembly is covered with a planar member.

* * * * *